US005310480A

United States Patent [19]

Vidueira

[11] Patent Number: 5,310,480

[45] Date of Patent: May 10, 1994

[54] PROCESSES FOR THE SEPARATION OF AROMATIC HYDROCARBONS FROM A HYDROCARBON MIXTURE

[75] Inventor: Jose A. Vidueira, White Plains, N.Y.

[73] Assignee: UOP, Des Plaines, Ill.

[21] Appl. No.: 785,717

[22] Filed: Oct. 31, 1991

[51] Int. Cl.[5] ..... C10G 21/12

[52] U.S. Cl. ..... 208/313; 208/322; 208/323

[58] Field of Search ..... 208/313, 322, 323

[56] References Cited

U.S. PATENT DOCUMENTS

| | | | |
|---|---|---|---|
| 3,714,033 | 1/1973 | Somekh et al. | 208/321 |
| 4,053,369 | 10/1977 | Cines | 203/52 |
| 4,058,454 | 11/1977 | Asselin | 208/321 |
| 4,081,355 | 3/1978 | Preusser et al. | 208/313 |
| 4,498,980 | 2/1985 | Forte | 208/321 |
| 4,586,986 | 5/1986 | Preusser et al. | 203/22 |
| 4,595,491 | 6/1986 | Berns | 208/326 |
| 4,664,783 | 5/1987 | Preusser et al. | 208/313 |
| 4,776,927 | 10/1988 | Emmrich et al. | 203/58 |
| 4,997,547 | 3/1991 | Emmrich et al. | 208/313 |

*Primary Examiner*—R. Bruce Breneman
*Assistant Examiner*—Walter D. Griffin
*Attorney, Agent, or Firm*—Thomas K. McBride; John G. Tolomei; Richard P. Silverman

[57] ABSTRACT

Processes are disclosed for the separation of aromatic hydrocarbons from feedstreams containing mixtures of aromatic and non-aromatic hydrocarbons using extractive distillation with an aromatic selective solvent in order to separate the aromatic hydrocarbons from the non-aromatic hydrocarbons. A side stream comprising the aromatic hydrocarbons and trace amounts of entrained aromatic selective solvent is withdrawn from the extractive distillation column and passed to a cyclone separator to provide a lean solvent stream, a stream comprising the aromatic hydrocarbons. The raffinate is withdrawn as an overhead stream comprising non-aromatic hydrocarbons. Various solvents are disclosed and an especially preferred solvent is sulfolane.

14 Claims, 2 Drawing Sheets

PROCESSES FOR THE SEPARATION OF AROMATIC HYDROCARBONS FROM A HYDROCARBON MIXTURE

FIELD OF THE INVENTION

The present invention relates generally to the separation of aromatic hydrocarbons from a hydrocarbon mixture, and more particularly to processes employing extractive distillation to separate aromatic hydrocarbons from feedstreams containing mixtures of aromatic and non-aromatic hydrocarbons.

BACKGROUND OF THE INVENTION

One type of process for the recovery of high purity aromatic hydrocarbons such as benzene, toluene and xylenes (BTX) from various hydrocarbon feedstreams including catalytic reformate, hydrogenated pyrolysis gasoline, etc., utilizes an aromatic-selective solvent to extract the aromatic hydrocarbons by liquid-liquid extraction as the primary separating step. Typically, in the practice of such processes, a hydrocarbon feed mixture is contacted in an extraction zone with an aromatic-selective solvent which selectively extracts the aromatic components from the hydrocarbon feedstock, thereby forming a raffinate phase comprising one or more non-aromatic hydrocarbons, and an extract phase comprising solvent having aromatic components dissolved therein.

The aromatic hydrocarbons are typically recovered from the extract phase, i.e., separated from the aromatic-selective solvent and further purified by one or more distillation steps. Often, extractive and/or steam distillation is employed to assist in recovering the aromatic hydrocarbons from the solvent because both methods are particularly effective as compared to other separation techniques such as simple distillation.

In many liquid-liquid extraction processes, the raffinate phase from the extraction zone is purified by water-washing. Typically, the water used for washing the raffinate phase is obtained from the aqueous phase of an overhead, or side draw, distillate from an extract phase steam distillation column, i.e., condensed steam, in order to provide an efficient, integrated water circulation loop. The aqueous phase, which has low levels of solvent, is then passed to one or more raffinate wash columns where residual aromatic extraction solvent is recovered from the raffinate phase. Spent raffinate wash water is typically passed to a steam generator, or otherwise vaporized, along with any other solvent-containing water streams that may be present in the process to provide stripping steam which is introduced to the extract phase distillation columns as noted above.

One process for producing high purity aromatics is described in U.S. Pat. No. 3,714,033, issued to Somekh et al., and provides for the use of a liquid-liquid extraction column and a single distillation column wherein both extractive distillation and a steam stripping occur. The patent discloses the preferred use of a polyalkylene glycol solvent which can provide a high purity aromatics product.

Another process for producing high purity aromatics is described in U.S. Pat. No. 4,058,454, issued to Asselin, and provides for the use of a liquid-liquid extraction column and extractive and steam distillation in separate columns. A particularly suitable class of solvents for use in accordance with the above-identified patent is commonly referred to as the sulfolane type which can provide a high purity aromatic product.

Still another process for producing high purity aromatics is disclosed in U.S. Pat. No. 4,081,355, issued to Preusser et al., and describes a process for recovering highly pure aromatic substances from mixtures of hydrocarbons which contain, in addition to the aromatic substances, large amounts of non-aromatic substances by liquid-liquid extraction in combination with an after arranged extractive distillation whereby the liquid-liquid extraction of the starting hydrocarbon mixture is carried out to provide an extract, introducing this extract into an after arranged extractive distillation for further separating said extract whereby the sump product (extract phase) formed is drawn off and introduced into an after arranged distillation column where it is separated into an aromatic and a solvent fraction, while the head product of the extractive distillation (raffinate phase) is reintroduced into the bottom of the extractor for liquid-liquid extraction thereof, wherein there is used in both of the extracting stages, as selective solvent, morpholine and/or N-substituted morpholine in admixture with water.

In addition to the above-described liquid-liquid extraction processes, some processes for separating aromatic hydrocarbons from mixtures with non-aromatic hydrocarbons have been proposed which use extractive distillation as the primary separating step. Generally, the extractive distillation processes provide higher recoveries of the heavier aromatic hydrocarbons such as $C_8$ aromatics and lower recoveries of light aromatics such as benzene than the liquid-liquid extraction processes.

Extractive distillation is a widespread practical and useful process for separating mixtures of materials and in particular of hydrocarbons, which cannot or can only partially be separated by simple distillation based on the boiling points of their components. In contrast to the liquid-liquid extraction frequently employed for separation of this nature, extractive distillation can exhibit advantages relating to apparatus construction and process engineering. For example, extractive distillation processes typically require only two distillation columns. Furthermore, in extractive distillation the mass transfer between the solvent and the material to be extracted can be improved due to the higher temperatures employed as compared to liquid-liquid extraction. This can result in an improved loading and for the same throughput and thus, smaller amounts of solvent can be sufficient. The obtainable advantages in apparatus construction can result in considerably smaller capital costs for an extractive distillation plant compared to those of a liquid-liquid extraction plant. The operating costs can also be lower and are sometimes only about 50% of those of a corresponding liquid-liquid extraction plant.

In liquid-liquid extraction the formation of two liquid phases is a precondition for successful separation of the starting materials. Ideally, one phase of the liquid-liquid extraction process consists of the solvent and of the components of the extract and the other phase consists of the components of the raffinate. It is frequently beneficial in liquid-liquid extraction to add water to the extraction for improving the selectivity and for favoring the formation of two liquid phases. Adding water results in the requirement of separate water circuits which can contribute to the increase of the capital costs of a liquid-liquid extraction plant but which cost is often far outweighed by the benefits of employing steam distillation for solvent recovery and purification of the aromatic product.

The underlying premise for the justification for employing extractive distillation has been completely different. The aromatic-selective solvent employed in many extractive distillation processes is anhydrous in order to eliminate the requirement of separate water circuits. The separating effect in extractive distillation is based on the change of the vapor pressures of the individual components present in the mixture to be separated in the presence of the solvent. The changes are in the direction as to increase the vapor pressure differences between the components to be separated into either the extract or into the raffinate. Thus, the raffinate can be distilled off at the top of the extractive distillation column as the lower boiling fraction. Accordingly, it has been thought that aqueous systems were unnecessary and, therefore, undesirable.

The processes disclosed in the following patents are typical of the extraction distillation processes used for aromatic hydrocarbon recovery.

U.S. Pat. No. 4,586,986, issued to Preusser et al. discloses a method for recovering pure aromatic substances from a mixture of hydrocarbons containing both aromatic and non-aromatic fractions. The input mixture is fed through an extractive stage provided with a preliminary distillation column. In the preliminary stage the aromatics-containing product is treated at a pressure up to 20 bar and a temperature up to 300° C. The pressure is adjusted to a value at which the operational temperature of the preliminary stage is higher than the pressure and temperature in the extractive stage and the heat of the vapors discharged from the preliminary stage is used for heating the extractive stage.

U.S. Pat. No. 4,664,783, issued to Preusser et al., discloses a method for the separation of aromatics from hydrocarbon mixtures, by means of extractive distillation, employing as selective solvent N-substituted morpholine, the substitutions of which display no more than 7 carbon atoms. The raffinate produced as top product of the extractive distillation is subjected to a second distillation, whereby the produced sump product with a solvent content between 20–75% by weight and a temperature between 20°–70° C., is led into a separation container and there separated into a heavy and a light phase. The heavy phase is then recycled into the extractive distillation column, whereas the light phase is recycled into the second distillation column.

U.S. Pat. No. 4,776,927, issued to Emmrich et al., discloses a process for the separation of aromatics from hydrocarbon mixtures through extractive distillation using N-substituted morpholine displaying substituents having no more than 7 carbon atoms as the selective solvent. Part of the solvent is delivered to the uppermost plate of the extractive distillation column and the remainder of the solvent, preferably amounting to between 10 and 40% by weight, is introduced into the extractive distillation column in at least two partial streams onto plates above the inlet for the hydrocarbon mixture. The temperature of the respective solvent partial streams is adjusted to neither exceed the temperature of the corresponding delivery plates nor fall below this temperature by more than 10° C.

U.S. Pat. No. 4,997,547, issued to Emmrich et al., discloses a process for producing an aromatic concentrate suitable as a fuel blending component from a hydrocarbon mixture through extractive distillation using N-substituted morpholine substituents of which having more than 7 carbon atoms as the selective solvent. Emmrich et al. teach the production of two hydrocarbon streams, one cut in the range of the low temperature boiling hydrocarbons up to 105° C., and the other cut in the range of 105°–106° C. The patent further discloses a method for removing the solvent from the heavy hydrocarbons by a combination of water injection into the lean solvent.

U.S. Pat. No. 4,595,491, issued to Berns, discloses a process for the separation of an aromatic hydrocarbon from a hydrocarbon mixture of varying aromatic content, by means of extractive distillation, employing as a selective solvent, an N-substituted morpholine, wherein the N-substituent contains up to 7 carbon atoms. In the entry product, the weight ratio of light non-aromatic hydrocarbons to heavy non-aromatic hydrocarbon should amount to at least 0.4 to 1. The light non-aromatic hydrocarbon necessary for adjustment of this ratio can be either introduced directly into the lower part of the extractive distillation column, or added to the entry product before introducing the latter to the extractive distillation column.

In view of the two types of processes described above for separating aromatic hydrocarbons from mixtures with non-aromatic hydrocarbons, i.e., the liquid-liquid extraction processes and the extractive distillation processes, improved processes are sought which can combine the beneficial aspects of the two types of processes. More specifically, an improved process is sought which incorporates extractive distillation as the primary separation step in separating the aromatic hydrocarbons from the non-aromatic hydrocarbons and also incorporates separating the aromatic hydrocarbons from the aromatic extraction solvents. In addition, further improvements are sought whereby the entire process can be performed in a single fractionation column apart from miscellaneous equipment such as water-wash columns and the like. Furthermore, it is desired to produce an aromatic concentrate and a raffinate concentrate using an aromatic selective solvent.

SUMMARY OF THE INVENTION

In accordance with the present invention, there is now provided a process for recovering aromatic hydrocarbons from feedstreams containing aromatic and non-aromatic hydrocarbons by an extractive distillation process using extractive distillation with an aromatic-selective solvent which takes place within a single distillation column to provide an aromatic product and a regenerated lean solvent stream which can be recycled back to the extractive distillation column. The process of the present invention includes the steps of (a) passing the feedstream to a reboiled extractive distillation column maintained at distillation conditions effective to separate aromatic from non-aromatic hydrocarbons and contacting the feedstream within said column with a cooled lean solvent stream comprising an aromatic-selective solvent and a stripping medium comprising water; (b) withdrawing a raffinate stream comprising non-aromatic hydrocarbons and water from an overhead section of said column; (c) withdrawing a side stream comprising the aromatic hydrocarbons, water and a trace amount of aromatic-selective solvent from an intermediate fractionation zone of said column; (d) withdrawing a hot lean solvent stream comprising the aromatic selective solvent from the bottom fractionation zone of the distillation column; and (e) passing the side stream to a cyclone separator to provide an aromatic rich overhead stream and a first aqueous stream comprising trace amounts of aromatic selective solvent and water.

In preferred aspects of the present invention, the process further includes heating and cooling steps such as: cooling the lean solvent stream by indirect heat exchange with the feedstream thereby partially vaporizing the feedstream prior to the passing it to the extractive distillation column; condensing the aromatic rich overhead stream to provide an aromatic product and a first aqueous phase; condensing the aromatic rich overhead stream to provide an aromatic product and a second aqueous phase; cooling the hot lean solvent stream by indirect heat exchange with a stripping water stream comprising at least a portion of at least one of the raffinate aqueous phase, the overhead aqueous phase or the side-draw aqueous phase; and further cooling the hot lean solvent stream by indirect heat exchange with the feedstream.

In another preferred aspect of the invention, the process further comprises the steps of passing the raffinate stream to a second cyclone separator wherein the raffinate stream is contacted with at least a portion of an overhead aqueous phase to remove entrained trace amounts of aromatic selective solvent and to provide an overhead raffinate stream; and cooling and condensing the overhead raffinate stream to provide a raffinate product and the overhead aqueous phase.

Essentially any solvent that is effective for performing the extractive distillation step in the extractive distillation column can be used as the aromatic selective solvent of the present invention. Preferred solvents include polyalkene glycols, such as tetraethylene glycol, either alone or mixed with glycol ethers, such as methoxytriglycol ether and sulfolane type solvents. The most preferred solvent for use in accordance with the present invention is sulfolane, which produced enhanced results, i.e., substantially lower energy consumption and higher throughput capacities (lower solvent to feed ratios) as compared to another suitable solvent (mixed tetraethylene glycol and methoxytriglycol ether).

DETAILED DESCRIPTION OF THE INVENTION

Figure 1:
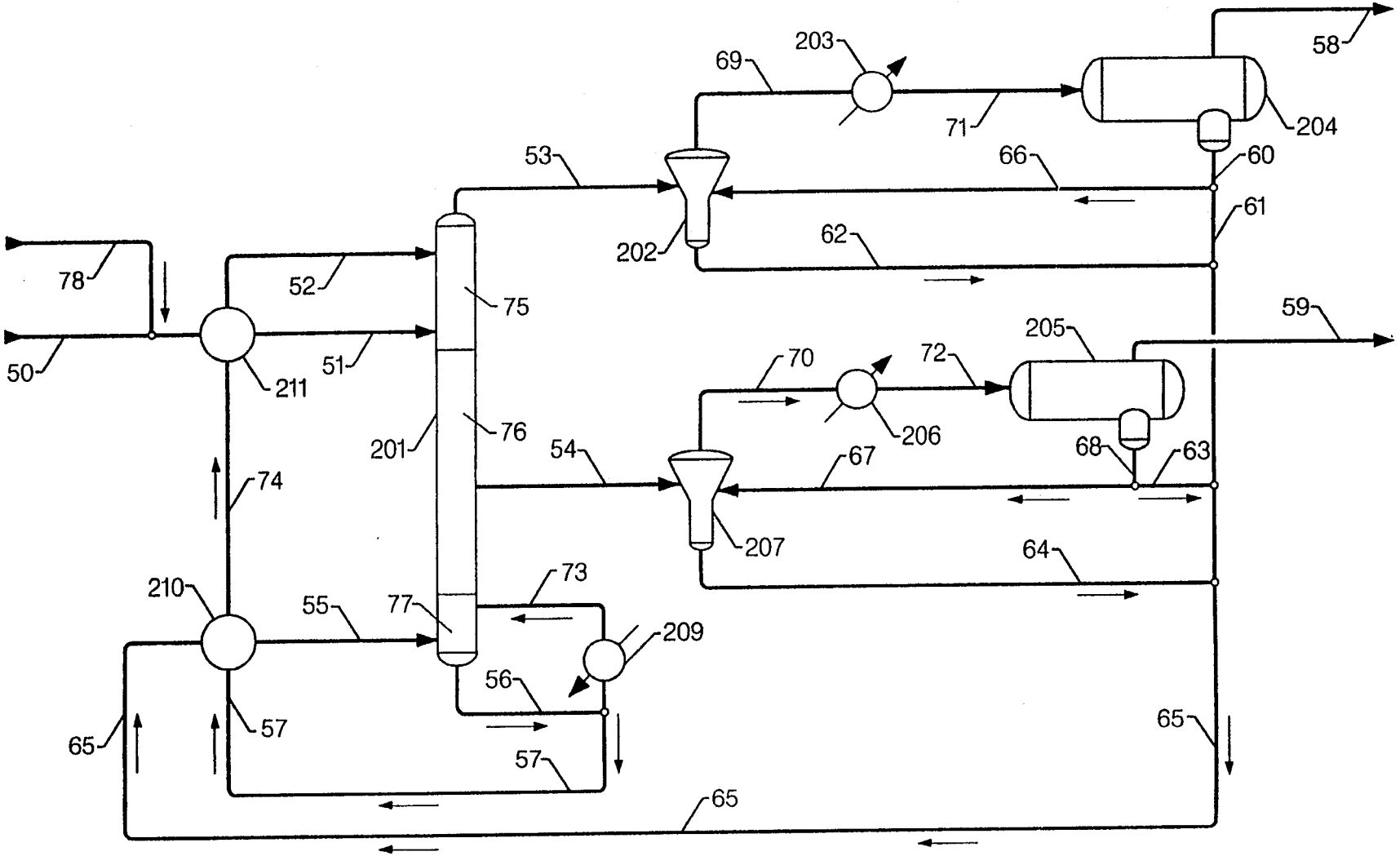
FIG. 1 illustrates a process flowscheme in accordance with the present invention wherein the solvent is sulfolane.

Hydrocarbon feedstreams suitable for utilization in the process of the present invention include many different aromatic-non-aromatic mixtures having a substantially high enough concentration of aromatic hydrocarbons to economically justify the recovery of the aromatic hydrocarbons as a separate product stream. Generally, the present invention is applicable to hydrocarbon feed mixtures containing from about 15–90% by weight aromatic hydrocarbons. Typical aromatic feedstreams suitable for use with the present invention will contain from about 55–90 vol. % aromatic hydrocarbons with aromatic hydrocarbon concentrations as high as 95% being suitable in some instances. A suitable carbon range for the hydrocarbon feedstream is from about 5 carbon atoms per molecule to about 20 carbon atoms per molecule, and preferably from 5 to 10 carbon atoms per molecule.

One suitable source of hydrocarbon feedstream is a depentanized fraction from the effluent from a conventional catalytic reforming process unit for the reforming of a naphtha feedstream. Another suitable source of feedstream is the liquid by-product from a pyrolysis gasoline unit which has been hydrotreated to saturate olefins and diolefins, thereby producing a rich aromatic hydrocarbon feedstream suitable for the separation technique described herein.

An especially preferred feedstream for use in the present invention is one recovered from a catalytic reforming unit, comprises single ring aromatic hydrocarbons of the $C_6$–$C_{12}$ range which are also mixed with corresponding boiling range paraffins and naphthenes which are present in the product from a catalytic reforming unit.

Solvent compositions which may be utilized in the practice of the present invention are those selected from the classes which have high selectivity for aromatic hydrocarbons. These aromatic selective solvents generally contain one or more organic compounds containing in their molecule at least one polar group, such as a hydroxyl, amino, cyano, carboxyl or nitro radical. In order to be effective, the organic compounds of the solvent composition having the polar radical should have a boiling point greater than the boiling point of water when water is included in the solvent composition for enhancing its selectivity. In general, the aromatic selective solvent should also have a boiling point greater than the end boiling point of the aromatic component to be extracted from the hydrocarbon feed mixture.

Organic compounds suitable for use as part of the aromatic-selective solvent composition are preferably selected from the group of those organic-containing compounds which include the aliphatic and cyclic alcohols, cyclic monomeric sulfones, the glycols and glycol ethers, as well as the glycol esters and glycol ether esters. The mono- and polyalkylene glycols in which the alkylene group contains from 2 to 4 carbon atoms, such as ethylene glycol, diethylene glycol, triethylene glycol, and tetraethylene glycol, propylene glycol, dipropylene glycol, and tripropylene glycol, as well as the methyl, ethyl, propyl and butyl ethers of the glycol hydroxyl groups and the acetic acid esters thereof, constitute a satisfactory class of organic solvents useful in admixture with water as the aromatic-selective solvent composition for use in the present invention.

Some of these aromatic-selective solvents, when combined with other cosolvents, can provide mixed solvents having desirable properties and as such are useful as aromatic-selective solvents of the present invention. One such mixed solvent comprises as one component the low molecular weight polyalkylene glycols of the formula:

$$HO-[CHR_1-(CR_2R_3)_n-O]_m-H$$

wherein n is an integer from 1 to 5 and is preferably the integer of 1 or 2; m is an integer having a value of 1 or greater, preferably between about 2 to about 20 and most preferably between about 3 and about 8; and wherein $R_1$, $R_2$ and $R_3$ may be hydrogen, alkyl, aryl, aralkyl or alkylaryl and are preferably hydrogen and alkyl having between 1 and about 10 carbon atoms and most preferably are hydrogen. Examples of the polyalkylene glycol solvents employable herein are diethylene glycol, triethylene glycol, 1,3-butylene glycol, 1,2-butylene glycol, 1,5-pentaethylene glycol, and mixtures thereof and the like. Preferred solvents are diethylene glycol, triethylene glycol, tetraethylene glycol being most preferred. One such cosolvent component comprises a glycol ether of the formula:

$$R_4O-[CHR_5-(CHR_6-)-_xO]_y-R_7$$

wherein $R_4$, $R_5$, $R_6$ and $R_7$ may be hydrogen, alkyl, aryl, aralkyl, alkylaryl and mixtures thereof with the proviso that $R_4$ or $R_7$ are not both hydrogen. The value of x is an integer from 1 to 5, preferably 1 or 2 and y may be an integer from 1 to 10 and is preferably from 2 to 7, and most preferably from 2 to 5. $R_4$, $R_5$, $R_6$ and $R_7$ are preferably selected from the group consisting of hydrogen and alkyl having 1 to about 10 carbons with the proviso that $R_4$ and $R_7$ may not both be hydrogen and most preferably $R_4$ is alkyl having from 1 to 5 carbons and $R_5$, $R_6$ and $R_7$ are hydrogen. The mixture(s) of solvent and cosolvent is selected such that at least one solvent and one cosolvent are provided to form the mixed solvent. The cosolvent generally comprises between about 0.1 and about 99 percent of the mixed solvent, preferably between about 0.5 and about 80 percent and more preferably between about 5 and about 60 percent by weight based on the total weight of the mixed solvent. Examples of the glycol ethers employable herein include methoxytriglycol, ethoxytriglycol, butoxytriglycol, methoxytetraglycol and ethoxytetraglycol and mixtures thereof. The above-described mixed solvents are fully disclosed in U.S. Pat. No. 4,498,980, hereby incorporated by reference.

Another typical aromatic-selective solvent utilized in commercial aromatic extraction processes which is especially preferred for use in accordance with the practice of this invention, is commonly referred to as sulfolane (tetrahydrothiphene,1-1 dioxide) and has the following structural formula:

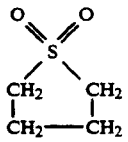

Also suitable are those sulfolane derivatives corresponding to the structural formula:

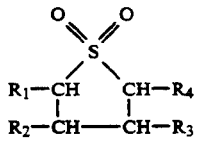

wherein $R_1$, $R_2$, $R_3$ and $R_4$ are independently selected from the group consisting of hydrogen, an alkyl radical containing from about 1 to about 10 carbon atoms, an aralkyl radical having from about 7 to about 12 carbon atoms, and an alkoxy radical having from about 1 to about 8 carbon atoms. Other solvents which may be included within this process are the sulfolenes, such as 2-sulfolene or 3-sulfolene which have the following structures:

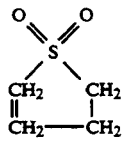

(2)

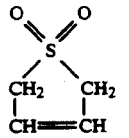

(3)

Other typical solvents which have a high selectivity for separating aromatics from non- aromatic hydrocarbons and which may be processed within the scope of the present invention are 2-methylsulfolane, 2,4-dimethylsulfolane, methyl-2- sulfonyl ether, N-aryl-3-sulfonylamine, 2-sulfonyl acetate, dimethylsulfoxide, N-methyl pyrrolidone, etc.

The aromatic selectivity of the solvent can usually be enhanced by the addition of water to the solvent. Preferably, the solvents utilized in the practice of this invention contain small quantities of water in order to increase the selectivity of the solvent for aromatic hydrocarbons without reducing substantially the solubility of the solvent for aromatic hydrocarbons. Accordingly, the solvent composition of the present invention preferably contains from about 0.1% to about 20% by weight of water and, more preferably, about 0.5 to about 10% by weight depending upon the particular solvent utilized and the process conditions at which the extractive distillation column is operated.

Aromatic hydrocarbons contained in the foregoing feedstreams are separated from the non-aromatic hydrocarbons by contacting the feedstream in an extractive distillation column maintained under conditions effective to promote the separation of the aromatic hydrocarbons from the non-aromatic hydrocarbons. The precise conditions used in the distillation column, preferably a reboiled extractive distillation column can be determined by one skilled in the art, although it is generally preferred that the extractive distillation conditions include a temperature of from about 200°–400° F. and a pressure of from about 15 to 100 psia.

The extractive distillation column will also contain a suitable number of trays or other packing material effective to perform the desired separation. The details of such trays and packing are known to those skilled in the art and accordingly do not need to be further discussed herein.

In the operation of a typical extractive distillation process, the overhead and side draw products may contain trace contaminants. These trace contaminants will be in the form of entrained liquid droplets comprising the aromatic selective solvent.

These traces of aromatic-selective solvent in the overhead and side draw streams are the result of mechanical losses occurring on the trays or in the packing material in the extractive distillation column. Typically, the entrained solvent is removed from the liquid phase raffinate and/or the aromatic-rich product by extraction with a wash water or a series of cooling and decanting steps. In using a vapor phase separation method, such as a cyclone separator or similar mechanical separation device, to remove the entrained solvent droplets, the above-mentioned liquid phase separation steps and the energy related costs for their operation may be eliminated resulting in a more efficient process that can be performed in a single extractive distillation column.

Preferably, the feedstream is introduced to an upper section within the extractive distillation column. In the extractive distillation column, the feedstream is contacted with a lean solvent stream comprising an aromatic-selective solvent which is preferably introduced at the top of an upper section of the distillation column. A raffinate stream comprising non-aromatic hydrocarbons and trace amounts of entrained aromatic-selective solvent is withdrawn from an upper fractionation zone of the distillation column. The raffinate stream is passed to an overhead cyclone separator wherein the vaporized raffinate stream is contacted with a stream comprising water in order to remove trace amounts of the aromatic-selective solvent from the hydrocarbons and provide an overhead cyclone separator vapor stream which is withdrawn from the top of the overhead cyclone separator. The overhead cyclone separator vapor stream is preferably at least partly condensed to provide an overhead hydrocarbon phase and an overhead aqueous phase. The overhead hydrocarbon phase is recovered as the raffinate byproduct and at least a portion of the aqueous phase is passed to the overhead cyclone separator to provide the contacting medium to improve the separation of the entrained solvent from the vapor stream in the cyclone separator. The remainder of the aqueous phase is returned to the extractive distillation column to provide stripping medium in the bottom section of the extractive distillation column. A stream comprising aromatic-selective solvent and water is withdrawn from the bottom of the overhead cyclone separator and returned to the bottom of the extractive distillation column as stripping medium. A side stream comprising trace amounts of the aromatic-selective solvent, aromatic hydrocarbons and water is withdrawn as a vapor side draw from an intermediate section of the distillation column.

The side stream obtained from the extractive distillation column is then passed to a cyclone separator which is maintained under conditions effective to separate entrained aromatic-selective solvent from the aromatic hydrocarbons. The precise conditions used within the cyclone separator can be determined by those skilled in the art, but preferably the conditions include a temperature of from about 150°-500° F. and a pressure of from about 1 to 100 psia.

In cyclone separators, a suspension comprising a vapor material with entrained finely divided solid or liquid droplets is introduced horizontally into the separator in a tangential manner so as to impart a spiral or centrifugal and swirling moment to the suspension. This centrifugal moment causes the liquid droplets to be thrown to the other wall of the cyclone separator for movement downward to a collecting zone therebelow. The vapor centrifugally separated from the entrained liquid is removed by a central zone ended passageway extending from a plane beneath the suspension tangential inlet upwardly through the top of the cyclone separator.

The details concerning the design and operation of cyclone separators is well known to those skilled in the art and need not be further discussed herein. See for example R. H. Perry and D. W. Green, *Perry Chemical Engineer's Handbook*, 6th Edition, Chapter 18, page 73 and Chapter 20, pages 83-86, McGraw Hill, Inc., 1984. A variation on the cyclone separator which may be employed in the invention involves the use of a centrifugal separator known as a tangential entry separator. In the tangential entry separator the cone bottom is replaced with a dished or flat head and the liquid in the bottom head is isolated from the separator volume by a horizontal plate which allows the separated liquid to pass into the bottom of the vessel. For a description of these devices see, for example, R. W. Rousseau *Handbook of Separation Process Technology*, pages 135-138, John Wiley & Sons, 1987. In both the cyclone separator and the tangential entry separator, the introduction of a coarse spray of liquid in the inlet can improve the efficiency of the removal of entrained liquid from the vapor stream. Large droplets which are more easily collected collide with finer droplets as they sweep the gas as it travels toward the wall of the separator. In some designs swirl baffles aid separation.

The term "lean solvent", as used herein, denotes an aromatic selective solvent of the present invention that has been at least partially regenerated, i.e., has capacity for aromatic hydrocarbons and has a reduced concentration of aromatic hydrocarbons.

In the cyclone separator the aromatic-rich side draw is contacted with water in order to separate the entrained solvent from the hydrocarbons and provide a first cyclone separator overhead stream which is withdrawn from the top of the cyclone separator. The cyclone separator overhead stream is preferably at least partially condensed to provide a side stream hydrocarbon phase and a side stream aqueous phase. The side stream hydrocarbon phase is recovered as concentrated aromatic hydrocarbon product. The cyclone separator bottoms stream comprising trace amounts of the aromatic selective solvent and water is returned to the extractive distillation column. At least a portion of the side stream aqueous phase is returned to the cyclone separator to provide a contact medium for the cyclone separator.

A stream comprising hot lean solvent is withdrawn from a bottom section of the extractive distillation column and at least a portion of it after cooling is passed to an upper section of the extractive distillation column as noted above. The remainder of the stream is reboiled and returned to the bottom section of the column.

Generally, to accomplish the separation in the extractive distillation column, the ratio of the extraction solvent to hydrocarbon feed is in the range from about 1 to about 15 parts by weight of extraction solvent to one part by weight of feed, the ratio from about 2:1 to about 10:1 being preferred and the ratio from about 2:1 to about 6:1 being the most preferred. The broad range for the ratio of the aromatic-selective solvent to hydrocarbon may be expanded upon depending on the particular solvent, the amount of water in the aromatic-selective solvent and the like. The optimum solvent to feed ratio also depends upon whether high recovery (yield) or high purity (quality) is desired although the instant process will allow for both high recovery and high purity.

Also embodied within the extractive distillation process of the present invention is the concept of admixing at least a portion of the benzene product recovered from the aromatic product of the process, preferably from 5 to 15% of the benzene product, with the feed to the extractive distillation column. The exact proportion of the benzene product admixed with the feed will vary somewhat with the feed composition. This addition of essentially pure benzene dilutes the feedstream and serves to improve the solubility of the feedstream in the solvent. It is well known in the art of extractive distillation that there is a potential for the formation of a second liquid phase at the conditions present in the upper fractionation zone creating three phases, two liquid and one vapor phase. The admixing of at least a portion of benzene product with the feed acts to minimize the potential of a second liquid phase forming, and furthermore improves the recovery of the aromatics from the feedstream. The addition of benzene to the feed is favored when the aromatic content of the feed is below 30 vol. %. The operational benefits of this benzene product recirculation outweigh the additional capital and operating costs.

Figure 2:
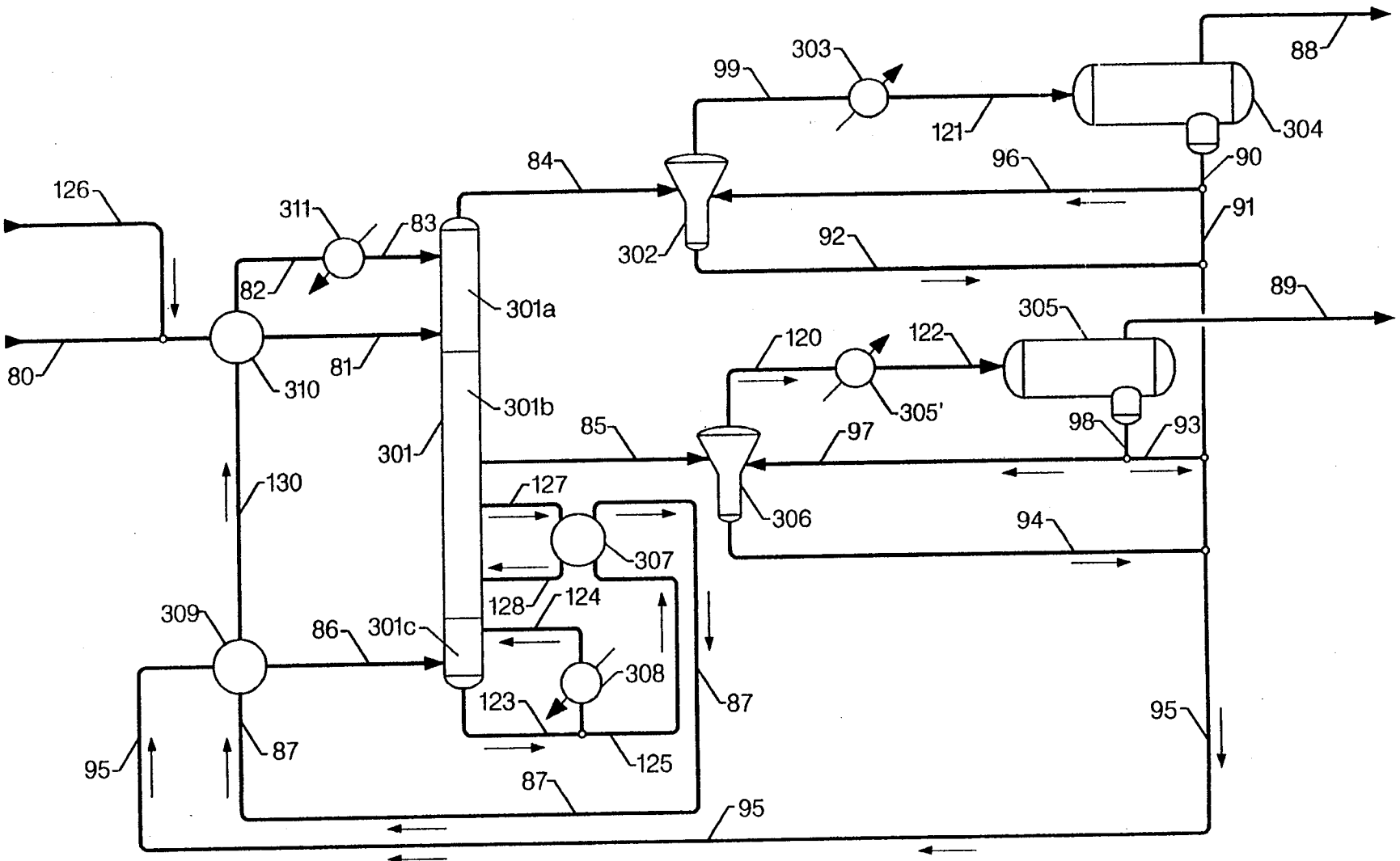
FIG. 2 illustrates a flowscheme in accordance with the present invention wherein the solvent is a mixture of tetraethylene glycol and methoxytriglycol ether.

The further description of the method of this invention is presented with reference to the attached schematics, FIG. 1 and FIG. 2. The Figures represent preferred aspects of the invention and are not intended to be a limitation on the generally broad scope of the invention as set forth in the claims. Of necessity, some miscellaneous appurtenances including valves, pumps, separators, heat exchangers, reboilers, etc., have been eliminated. Only those vessels and lines necessary for a complete and clear understanding of the process of the present invention are illustrated.

FIG. 1 illustrates a process flow diagram of an aspect of the present invention wherein sulfolane solvent is used as the solvent.

A $C_6$–$C_{12}$ of a depentanized reformate containing aromatic and non-aromatic hydrocarbons is passed by line 50 at a temperature of about 80° F. and 30 psia through heat exchanger 211 wherein it is heated and partially vaporized by indirect heat exchange with a lean solvent stream in line 74, the source of which is hereinafter defined, to a temperature of about 210° F. and is passed by line 51 to the top of an upper fractionation zone 75 of an extractive distillation column 201. The extractive distillation consists of an upper fractionation zone 75, an intermediate fractionation zone 76 and a bottom fractionation zone 77. A vaporized raffinate stream comprising non-aromatic hydrocarbons, trace amounts of entrained aromatic selective solvent and water is withdrawn from the top of an upper fractionation zone 75 of distillation column 201, at a temperature of about 142° F. and passed by line 53 to a first cyclone separator means 202. In the first cyclone separator the raffinate 53 is contacted with a stream 66 comprising water, and the vapor portion of the raffinate is separated from a liquid portion: the vapor stream leaving in stream 69, and the liquid portion comprising solvent leaving in stream 62. The vapor stream 69 is passed to water cooler 203 where it is cooled to about 110° F. and passed by line 71 to separation vessel 204 wherein a raffinate hydrocarbon phase and raffinate aqueous phase are formed. The raffinate hydrocarbon phase, or raffinate byproduct, is withdrawn by line 58. The extractive distillation column is maintained at an average pressure of about 25 psia. A lean solvent stream is withdrawn from a bottom section of distillation column 201 by a line 56 at a temperature of about 330° F. and a portion thereof is heated in reboiler 209 and returned to the distillation column in line 73.

The remaining portion of the lean solvent stream is passed by line 57 to a second heat exchanger 210 where it is heat exchanged with a stripping medium stream 65, the source of which is herein defined, to cool the lean solvent to a temperature of 250° F. and to at least partially vaporize the stripping medium stream 65 before it is passed by line 55 to the bottom fractionation zone 77 of the extractive distillation column 201. The cooled lean solvent is withdrawn as stream 74 as hereinbefore described.

A vaporized side stream 54 comprising aromatic hydrocarbon product, trace amounts of entrained aromatic selective solvent and water is withdrawn from the intermediate fractionation zone 76 of the extractive distillation column 201 and passed to a second cyclone separator means 207 wherein stream 54 is contacted with a water stream 67, the source of which is herein described. A vapor phase stream comprising hydrocarbon aromatic product and water is withdrawn from the top of the second cyclone separator means 207 in line 70. A liquid phase is withdrawn from the bottom of the second cyclone separator means in line 64. The vapor stream in line 70 is passed to a second water cooler 206 where it is cooled to about 110° F. and passed by line 72 to a separation vessel 205 wherein a hydrocarbon aromatic product phase is withdrawn by line 59, and an aqueous phase is withdrawn in line 68. At least a portion of line 68 comprising water is passed to the second cyclone separator means 207 by line 67 and the remaining portion is passed by line 63 to line 65 to be used as stripping medium in the extractive distillation column 201. At least a portion of liquid phase in line 64 comprising aromatic-selective solvent and water is passed to line 65.

The hydrocarbon aromatic product in line 59 is subsequently sent to a series of two fractionation columns (not shown) to separate the hydrocarbon aromatic product into benzene, toluene and xylene. The first column separates benzene as a top product and the second column processes the bottom product of the first column comprising toluene and xylenes to produce toluene as a top product and xylenes and heavier hydrocarbons as a bottoms product. At least a portion of the benzene product in stream 78 is admixed with the feed 50 to the extractive distillation column 201.

At least a portion of the aqueous streams, i.e., lines 61, 62, 63 and 64, are then combined and passed by line 65 as stripping medium to heat exchanger 210 wherein the stripping medium is heated to a temperature of about 241° F. and is at least partially vaporized and passed by line 55 into the bottom of the extractive distillation column 201. Make-up water can be added as required by admixing with the stripping medium in line 65.

FIG. 2 illustrates a process flow diagram in accordance with the present invention wherein a mixture of tetraethylene glycol and methoxyglycol is used as the solvent.

A $C_6$–$C_{12}$ cut of a depentanized reformate containing aromatic and non-aromatic hydrocarbons is passed by line 80 at a temperature of about 80° F. and 30 psia through heat exchanger 310 wherein it is heated and partially vaporized by indirect heat exchange with a lean solvent stream in line 130, the source of which is hereinafter defined, to a temperature of about 224° F. and is passed by line 81 to an upper fractionation zone **301*a* of an extractive distillation column 301. The extractive distillation consists of an upper fractionation zone 301*a*, an intermediate fractionation zone 301*b* and a bottom fractionation zone 301*c*. A partially vaporized raffinate stream comprising non-aromatic hydrocarbons and water is withdrawn from an upper fractionation zone 301*a* of distillation column 301, at a temperature of about 214° F. and passed by line 84 to a cyclone separator 302** wherein the raffinate is contacted with a stream 96, comprising water and the vapor portion of the raffinate is separated from a liquid portion, the vapor stream leaving in stream 99 and the liquid portion comprising solvent leaving in stream 92. The vapor stream 99 is passed to water cooler 303 where it is cooled to about 100° F. and passed by line 121 to separation vessel 304 wherein a raffinate hydrocarbon phase, or raffinate byproduct, and a raffinate aqueous phase are formed. The raffinate byproduct is withdrawn by line 88. The raffinate aqueous phase is withdrawn as stream 90. At least a portion of the raffinate aqueous phase is returned to the cyclone separator in stream 96 to improve the efficiency of the separation in the cyclone separator. The remaining portion of the aqueous phase in stream 91 is combined with the stream 92 and returned to the extractive distillation column as stripping medium.

A vapor side stream 85 comprising aromatic hydrocarbon product, trace amount of entrained aromatic selective solvent and water is withdrawn from the intermediate fractionation zone 301*b* of the extractive distillation column 301 and passed to a second cyclone separator 306 wherein stream 85 is contacted with a water stream 97, the source of which is herein described. A vapor phase stream comprising hydrocarbon aromatic product and water is withdrawn from the top of the cyclone separator 306 in line 120. A liquid phase is withdrawn from the bottom of the second cyclone separator means in line 94 comprising entrained solvent. The vapor stream in line 70 is passed to a second water cooler 305′ where it is cooled to about 110° F. and passed by line 122 to a separation vessel 305 wherein a hydrocarbon aromatic product phase is withdrawn by line 89, and an aqueous phase is withdrawn in line 98. At least a portion of line 98 comprising water is passed to the second cyclone separator means 306 by line 97 and the remaining portion is passed by line 93 to line 95 to be used as stripping medium in the extractive distillation column 301. The liquid phase in line 94 comprising solvent and water is passed to line 95.

The hydrocarbon aromatic product in line 89 is subsequently sent to a series of two fractionation columns (not shown) to separate the hydrocarbon aromatic product into benzene, toluene and xylene. The first column separates benzene as a top product and the second column processes the bottom of the first column comprising toluene and xylenes to produce toluene as a top product and xylenes and heavier aromatic hydrocarbons as a bottoms product. At least a portion of the benzene product stream 126 is admixed with the feed 80 to the extractive distillation column 301.

The extractive distillation column is maintained at an average pressure of about 25 psia. A lean solvent stream is withdrawn from a bottom fractionation zone 301*c* of distillation column 301 in a line 123 at a temperature of about 340° F. and a portion thereof is heated in reboiler 308 and returned to the distillation column in line 124.

The remaining portion of the lean solvent is passed by line 125 to a second heat exchanger 307 wherein the lean solvent in line 125 is cooled about 45° F. to a temperature of 295° F. by cross exchange with a portion of a liquid stream 127 within the column at a point in the intermediate zone, below the point where the vapor side draw was withdrawn. The cooler column liquid is returned to the column by stream 128. The cooler lean solvent stream is passed by stream 87 to a third heat exchanger 309 which further cools the lean solvent to a temperature of 277° F. by partially vaporizing the stripping medium in stream 95 and returning the at least partially vaporized stripping medium to the column 301 via line 86 to the bottom fraction zone 301*c*. The twice cooled lean solvent is passed to the first heat exchanger 310 as hereinabove described, the thrice cooled lean solvent is passed to a fourth heat exchanger 311 in stream 82 wherein it is cooled with water to a temperature of 209° F. before being passed to the top of the extractive distillation column 301.

The aqueous streams, i.e., lines 91, 92, 93 and 94, are combined and passed by line 95 as stripping medium to heat exchanger 309 wherein the stripping water is heated to a temperature of about 243° F. and is at least partially vaporized and passed by line 86 into a bottom fractionation zone 301*c* of column 301. Make-up water can be added as required preferably as wash water feed for the raffinate wash.

Table 1, below, sets forth the analysis of the feedstream described with reference to FIGS. 1 and 2. Table 2, below, illustrates the results of a computer simulation based on the two processes described with reference to FIGS. 1 and 2.

TABLE 1

| Feed Properties | |
|---|---|
| Component | Weight % |
| Benzene | 23.91 |
| Toluene | 17.61 |
| Xylenes | 3.43 |
| Pentanes | 1.65 |
| Hexanes | 35.67 |
| Heptanes | 12.11 |
| Octanes | 4.10 |
| Cyclopentane | 4.60 |
| Cyclohexane | 0.15 |
| Methyl-Cyclopentane | 0.79 |
| Methyl-Cyclohexane | 0.11 |
| | 100.00 |
| Flow rate | 201,100 lb/hr |

TABLE 2

| | Case A Figure 1 | Case B Figure 1 | Case C Figure 2 |
|---|---|---|---|
| Solvent-to-Feed (w/w) | 1.85 | 7.0 | 11.3 |
| Feed Temperature, F. | 80 | 80 | 80 |
| lb Stripping Water/lb Aromatics | 0.260 | 0.30 | 0.30 |
| lb Stripping Water/lb Solvent | 0.063 | 0.0193 | 0.0117 |
| Lean Solvent Temperature, F. | 133 | 105 | 209 |
| Water in Lean Solvent, Wt. % | 2.29 | 3.6 | 3.6 |
| Recovery | | | |
| Benzene | 100.0 | 71.96 | 99.57 |
| Toluene | 100.0 | 98.92 | 100.0 |
| Xylenes | 100.0 | 100.0 | 100.0 |
| Impurity, ppmy | 500 | 500 | 500 |
| Stripper Column | | | |
| No. Theoretical Stages | 40 | 40 | 40 |
| Feed Stage | 13 | 11 | 11 |
| Lean Solvent Feed Stage | 1 | 1 | 1 |
| Aromatics Side draw Stage | 22 | 22 | 22 |
| Interheater Stage | | | 30 |
| Temperature, F. Top/Bottom | 142/330 | 217/340 | 214/340 |
| Side draw Temperature, F. | 226 | 262 | 261 |
| Pressure, Psia Top/Bottom | 21.7/25.7 | 22.7/26.7 | 22.7/26.7 |
| Reboiler Duty, MM Btu/hr | 62 | 124.0 | 129.0 |
| Overhead Condenser Duty, MM Btu/hr | 16.9 | 23.7 | 16.0 |
| Side draw Condenser Duty, MM Btu/hr | 42.2 | 41.0 | 45.0 |
| Interheater Duty, MM Btu/hr | | | 69.0 |
| Wt. % Solvent in: | | | |
| 1. Stripper Overhead Vapor Stream | 0.017 | 0.015 | 0.0194 |
| 2. Stripper Side draw Vapor Stream | 0.150 | 0.021 | 0.1043 |

TABLE 2-continued

| | Case A Figure 1 | Case B Figure 1 | Case C Figure 2 |
|---|---|---|---|
| Duty, Btu/lb Aromatics | 680 | 1620 | 1425 |

It can be seen from the results of the above-described example that both solvents simulated are suitable for use in accordance with the present invention. The solvent mixture cases contained between 5 to 30 wt. % methoxytriglycol ether in the tetraethylene glycol on a water free basis. Table 2 illustrates three cases developed to demonstrate the operation of the present invention as follows CASE A—Sulfolane solvent CASE B—Mixed extraction solvent comprising methoxytriglycol and tetraethylene glycol with low benzene recovery CASE C—Mixed extraction solvent of Case B with improved benzene recovery In Cases A and C in which the benzene recoveries and purities were substantially the same, the energy consumption of the process with the sulfolane solvent was substantially less than with the solvent mixture comprising tetraethylene glycol and methoxytriglycol ether. More specifically, the duty reported as Btu's/lb of aromatics for the sulfolane case was only 48% of the duty for the mixed solvent case, i.e., 680 Btu's/lb versus 1425 Btu's/lb. In addition, the solvent to feed ratio for the sulfolane case was only about 72% of the solvent to feed ratio required for the solvent mixture case, i.e., 1.85 versus 11.3. The lower solvent to feed ratios are additionally beneficial because they can be translated to a higher throughput or capacity when operated at the higher solvent to feed ratio. Thus, for the same solvent circulation rate and the same recoveries, the sulfolane solvent can process about twice as much feed based on the solvent to feed ratios from FIG. 2.

Case B represents the direct replacement of the sulfolane solvent of Case A with the mixed extraction solvent. The differences between Cases B and C illustrated the additional equipment and heat integration steps required for cooling the lean solvent in order to improve the benzene recovery of the process when employing the mixed extraction solvent. The use of the additional lean oil cooling steps and the column interheater permitted the overall energy requirements of this operation to be reduced approximately 12% on the basis of the total heat required per pound of aromatics produced.

What is claimed is:

1. A process for separating aromatic hydrocarbon from a feedstream containing aromatic and non-aromatic hydrocarbons, comprising:

a) passing the feedstream to an upper fractionation zone of a reboiled extractive distillation column maintained at extractive distillation conditions including a temperature of from about 200° to 400° F. and a pressure of from about 15 to 100 psia effective to separate aromatic from non-aromatic hydrocarbons and contacting the feedstream within said distillation column with a cooled lean solvent stream comprising an aromatic-selective solvent and a stripping medium stream comprising water, said cooled lean solvent stream being introduced at the top of the upper fractionation zone and said stripping medium stream being introduced in a bottom fractionation zone;

b) withdrawing a raffinate stream comprising non-aromatic hydrocarbons and water from the upper fractionation zone of said distillation column;

c) withdrawing a side stream as a vapor side draw comprising aromatic hydrocarbons, water, and trace amounts of the aromatic-selective solvent from an intermediate fractionation zone of said distillation column;

d) withdrawing a hot lean solvent stream comprising the aromatic-selective solvent from the bottom fractionation zone of said distillation column;

e) passing the side stream to a first cyclone separator to provide an aromatic-rich overhead stream and a first aqueous stream;

f) passing the aromatic-rich overhead stream to a first condenser and a first phase separator to provide an aromatic product and a second aqueous phase;

g) passing the raffinate stream to a second cyclone separator to provide an overhead raffinate stream and a third aqueous phase and returning at least a portion of the second aqueous phase to the second cyclone separator;

h) cooling and condensing the overhead raffinate stream to provide a raffinate byproduct and a fourth aqueous phase;

i) combining at least a portion of the first, second, third and fourth aqueous phases to provide a stripping medium stream; and j) cooling said hot lean solvent stream to provide the cooled lean solvent stream.

2. The process of claim 1 wherein the aromatic-selective solvent comprises a polyalkene glycol.

3. The process of claim 2 wherein the polyalkene glycol comprises tetraethylene glycol.

4. The process of claim 1 wherein the aromatic-selective solvent comprises a polyalkylene glycol of the formula:

$$HO—[CHR_1—(CH_2R_3)_n—O]_m—H$$

wherein n is an integer from 1 to 5, m is an integer having a value of 1 or greater and $R_1$, $R_2$ and $R_3$ may each be hydrogen, alkyl, and mixtures thereof wherein $R_1$, $R_2$ and $R_3$ have from 1 to 10 carbon numbers and a glycol ether of the formula:

$$R_4O—[CHR_5—(CHR_6)_xO]_y—R_7$$

wherein $R_4$, $R_5$, $R_6$ and $R_7$ may each be hydrogen, alkyl, and mixtures thereof wherein $R_4$, $R_5$, $R_6$ and $R_7$ have from 1 to 10 carbon atoms with the proviso that $R_4$ and $R_7$ are not both hydrogen; x is an integer from 1 to 5; and y may be an integer from 2 to 10.

5. The process of claim 4 wherein said aromatic-selective solvent consists essentially of a polyalkylene glycol selected from the class consisting of diethylene glycol, triethylene glycol, tetraethylene glycol and mixtures thereof and a glycol ether selected from the class consisting of methoxytriglycol, ethoxytriglycol, butyoxytriglycol, methoxytetraglycol and ethoxytetraglycol and mixtures thereof wherein the glycol ether comprises between about 0.1 and 99 percentage by weight of the solvent.

6. The process of claim 5 wherein the polyalkylene glycol is tetraethylene glycol and the glycol ether is methoxytriglycol.

7. The process of claim 1 wherein said aromatic selective solvent comprises sulfolane.

8. The process of claim 1 wherein the cyclone separation conditions of the first cyclone separator include a temperature of from about 150° to 500° F. and a pressure of from about 1 to 100 psia.

9. The process of claim 1 wherein the feedstream includes aromatic hydrocarbons comprising at least one of benzene, toluene and xylenes.

10. The process of claim 1 wherein the feedstream includes non-aromatic hydrocarbons comprising paraffinic and cyclic hydrocarbons in the $C_5$–$C_{12}$ carbon range.

11. The process of claim 1 further comprising recovering a benzene product from said aromatic product and admixing of 5 to 15 volume percent of the benzene product with the feedstream prior to its introduction to the extractive distillation column.

12. The process according to claim 1 wherein said aromatic selective solvent comprises a sulfolane solvent of the general formula:

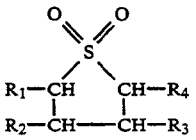

wherein $R_1$, $R_2$, $R_3$ and $R_4$ each is independently selected from the group consisting of hydrogen, an alkyl of 1 to 10 carbon atoms, an arylalkyl of from 7 to 12 carbon atoms and an alkoxy having from 1 to 8 carbon atoms.

13. A process for separating aromatic hydrocarbons from a feedstream containing aromatic and non-aromatic hydrocarbons, comprising:

a) passing the feedstream to an upper fractionation zone of a reboiled extractive distillation column maintained at extractive distillation conditions including a temperature of from about 200° to 400° F. and a pressure of from about 15 to 100 psia effective to separate aromatic from non-aromatic hydrocarbons and contacting the feedstream within said distillation column with a cooled lean solvent stream comprising an aromatic-selective solvent and a stripping medium stream comprising water, said cooled lean solvent stream being introduced at the top of the upper fractionation zone and said stripping medium stream being introduced in a bottom fractionation zone;

b) withdrawing a raffinate stream comprising non-aromatic hydrocarbons and water from the upper fractionation zone of said distillation column;

c) withdrawing a side stream as a vapor side draw comprising aromatic hydrocarbons, water, and trace amounts of the aromatic-selective solvent from an intermediate fractionation zone of said distillation column;

d) withdrawing a hot lean solvent stream comprising the aromatic-selective solvent from the bottom fractionation zone of said distillation column;

e) passing the side stream to a first cyclone separator to provide an aromatic-rich overhead stream and a first aqueous stream and returning at least a portion of the first aqueous phase to the first cyclone separator;

f) passing the aromatic-rich overhead stream to a first condenser and a first phase separator to provide an aromatic product and a second aqueous phase;

g) passing the raffinate stream to a second cyclone separator to provide an overhead raffinate stream and a third aqueous phase;

h) cooling and condensing the overhead raffinate stream to provide a raffinate byproduct and a fourth aqueous phase;

i) combining at least a portion of the first, second, third and fourth aqueous phases to provide a stripping medium stream; and j) cooling said hot lean solvent stream to provide the cooled lean solvent stream.

14. A process for separating aromatic hydrocarbons from a feedstream containing aromatic and non-aromatic hydrocarbons, comprising;

a) admixing the feedstream with at least a portion of a benzene product prior to passing the feedstream to an upper fractionation zone of a reboiled extractive distillation column maintained at extractive distillation conditions including a temperature of from about 200 to 400° F. and a pressure of from about 15 to 100 psia effective to separate aromatic from non-aromatic hydrocarbons and contacting the feedstream within said distillation column with a cooled lean solvent stream comprising sulfolane and a stripping medium stream comprising water, said cooled lean solvent stream introduced at the top of the upper fractionation zone and said stripping medium introduced in a bottom fractionation zone;

b) withdrawing a raffinate stream comprising non-aromatic hydrocarbons and water from the upper fractionation zone of said distillation column;

c) withdrawing a side stream as a vapor side draw comprising aromatic hydrocarbons, water, and trace amounts of sulfolane from an intermediate fractionation zone of said distillation column;

d) withdrawing a hot lean solvent stream comprising sulfolane from the bottom fractionation zone of said distillation column;

e) passing the side stream to a first cyclone separator to provide an aromatic-rich overhead stream and a first aqueous stream;

f) passing the aromatic-rich overhead stream to a first condenser and a first phase separator to provide an aromatic product and a second aqueous phase;

g) recovering a benzene product from the aromatic product and recycling at least a portion of the benzene product to be admixed with the feedstream;

h) passing the raffinate stream to a second cyclone separator to provide an overhead raffinate stream and a third aqueous phase;

i) cooling and condensing the overhead raffinate stream to provide a raffinate product and a fourth aqueous phase;

j) combining at least a portion of the first, second, third and fourth aqueous phases to provide a stripping medium stream and returning said stripping medium stream to the bottom fractionation zone;

k) cooling the hot lean solvent stream by indirect heat exchange with the stripping medium stream to provide a first-cooled lean solvent stream, thereby at least partially vaporizing the stripping medium stream prior to passing it to the bottom fractionation zone of said distillation column; and l) further cooling the first-cooled lean solvent stream by indirect heat exchange with the feedstream to provide the cooled lean solvent stream, thereby at least partially vaporizing the feedstream prior to passing said feedstream to the upper fractionation zone.

* * * * *